US005901848A

United States Patent [19]

Gorlich et al.

[11] Patent Number: 5,901,848

[45] Date of Patent: May 11, 1999

[54] PLURAL ATMOSPHERE PACKAGE

[75] Inventors: Michael P. Gorlich; Robert F. McPherson, Jr., both of Hilton Head Island, S.C.

[73] Assignee: Worlds Class Packaging Systems, Inc., Hilton Head Island, S.C.

[21] Appl. No.: 08/957,356

[22] Filed: Oct. 24, 1997

Related U.S. Application Data

[63] Continuation-in-part of application No. 08/559,657, Nov. 20, 1995, which is a continuation of application No. 08/459,102, Jun. 2, 1995, abandoned, which is a continuation of application No. 08/216,918, Mar. 23, 1994, Pat. No. 5,447,736, which is a continuation of application No. 08/064,700, May 20, 1993, Pat. No. 5,348,752.

[51] Int. Cl.[6] ..... B65D 1/36; A61B 19/02; B65B 55/02

[52] U.S. Cl. ..... 206/439; 206/561; 206/570; 220/359.1; 220/506; 220/524; 426/118; 426/396

[58] Field of Search ..... 206/438, 439, 206/570, 561; 426/106, 118, 396, 415; 220/506, 524, 526, 359.1, 359.2, 359.3, 359.4

[56] References Cited

U.S. PATENT DOCUMENTS

| | | | |
|---|---|---|---|
| 3,261,458 | 7/1966 | Nibecker | 220/506 X |
| 3,394,861 | 7/1968 | Truax | 220/359.1 |
| 4,482,053 | 11/1984 | Alpen et al. | 206/439 |
| 4,523,679 | 6/1985 | Paikoff et al. | 206/570 X |
| 4,656,042 | 4/1987 | Risler | 426/396 |
| 4,684,015 | 8/1987 | Vezirian et al. | 220/359.4 |
| 4,836,380 | 6/1989 | Walter et al. | 206/561 |
| 4,939,332 | 7/1990 | Hahn | 220/359 X |
| 4,989,733 | 2/1991 | Patry | 206/570 |
| 5,042,652 | 8/1991 | Grindrod | 206/557 X |
| 5,119,940 | 6/1992 | Grindrod | 206/561 X |
| 5,163,557 | 11/1992 | Sokolowski | 206/439 |
| 5,209,348 | 5/1993 | Schafer, III | 220/506 X |
| 5,348,752 | 9/1994 | Gorlich | 426/129 |
| 5,439,132 | 8/1995 | Gorlich | 220/359 |
| 5,447,736 | 9/1995 | Gorlich | 426/129 |

*Primary Examiner*—Bryon P. Gehman
*Attorney, Agent, or Firm*—Trop Pruner Hu & Miles, P.C.

[57] ABSTRACT

A package for containing food products has at least two compartments having different atmospheric conditions. Each of the compartments may be sealed by a membrane having different permeability. The membranes may be sealed to a peripheral flange extending around each of the compartments. The peripheral flange is designed to facilitate severing in place on the tray of a membrane from a continuous web of material.

4 Claims, 6 Drawing Sheets

FIGURE 1
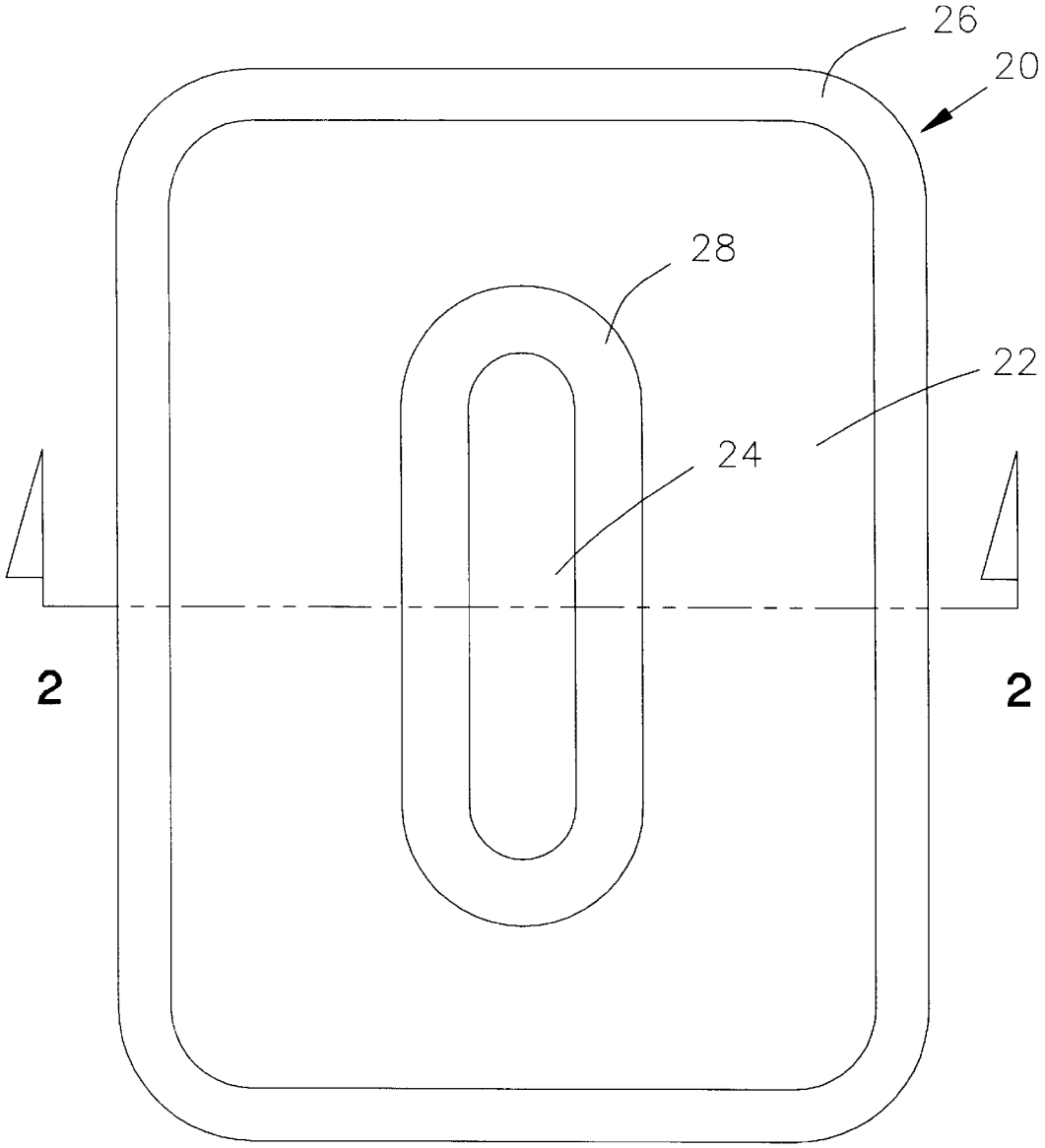
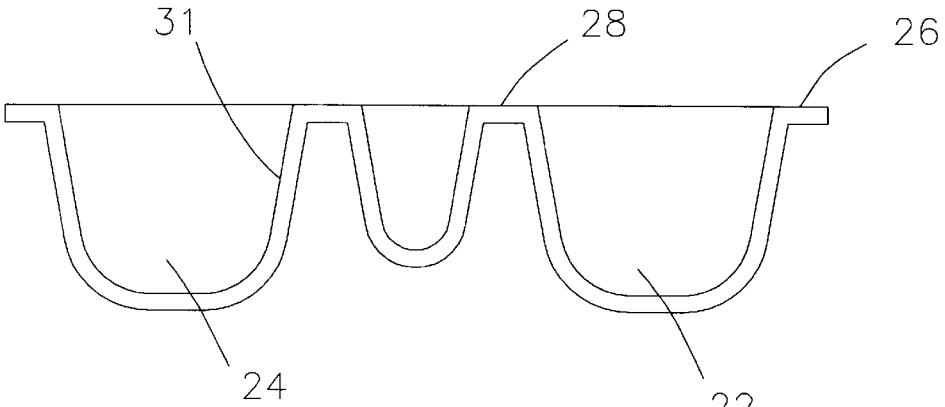
FIGURE 2

FIGURE 3
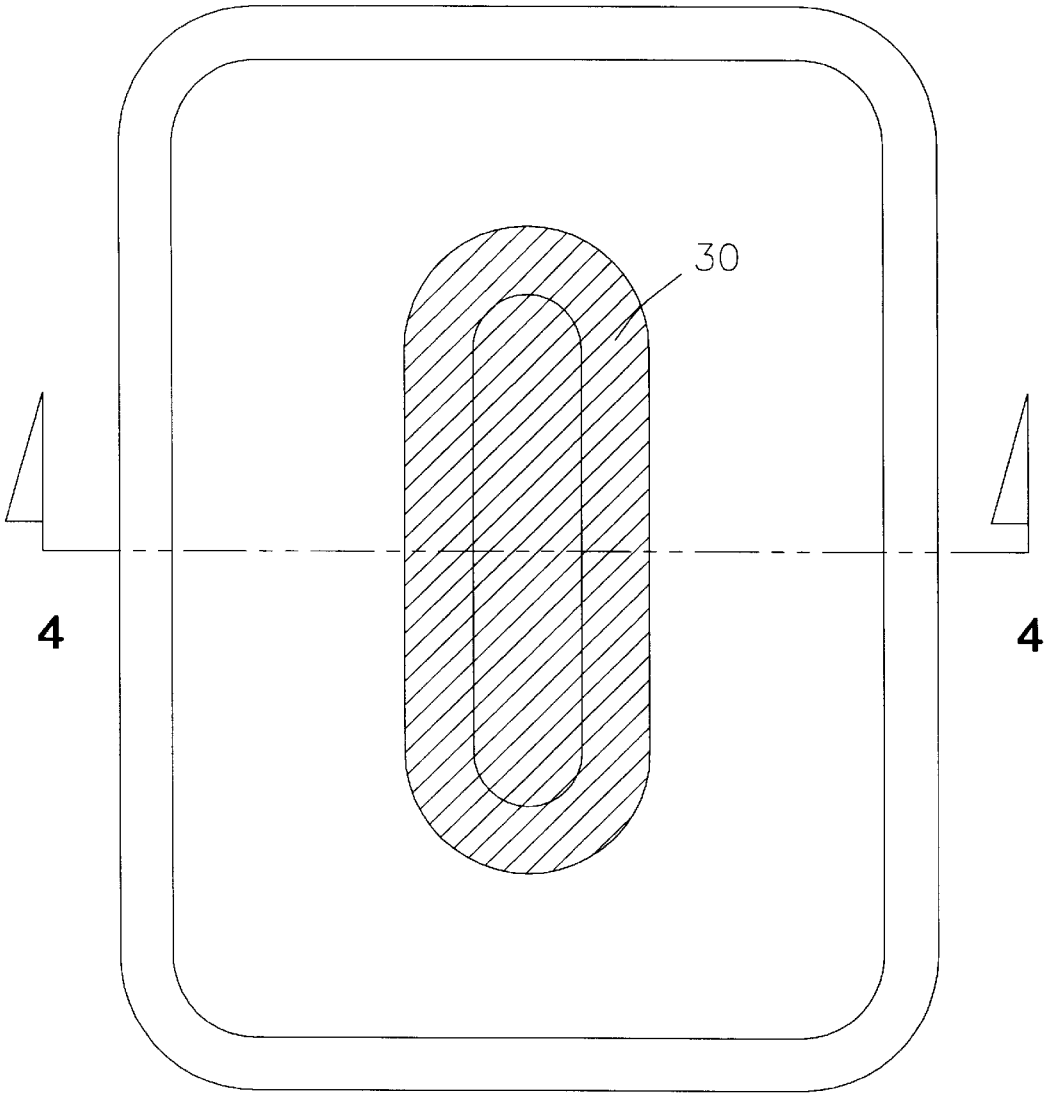
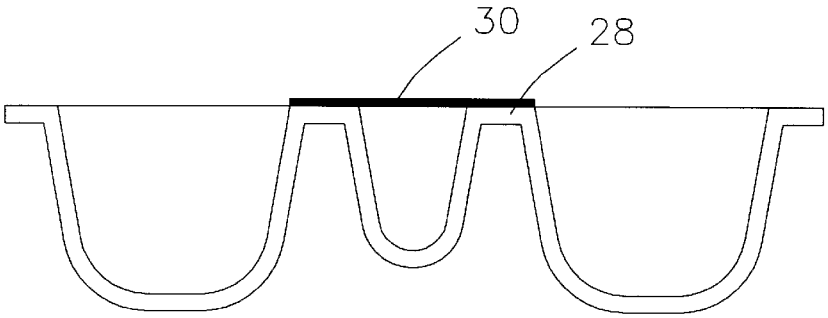
FIGURE 4

FIGURE 5
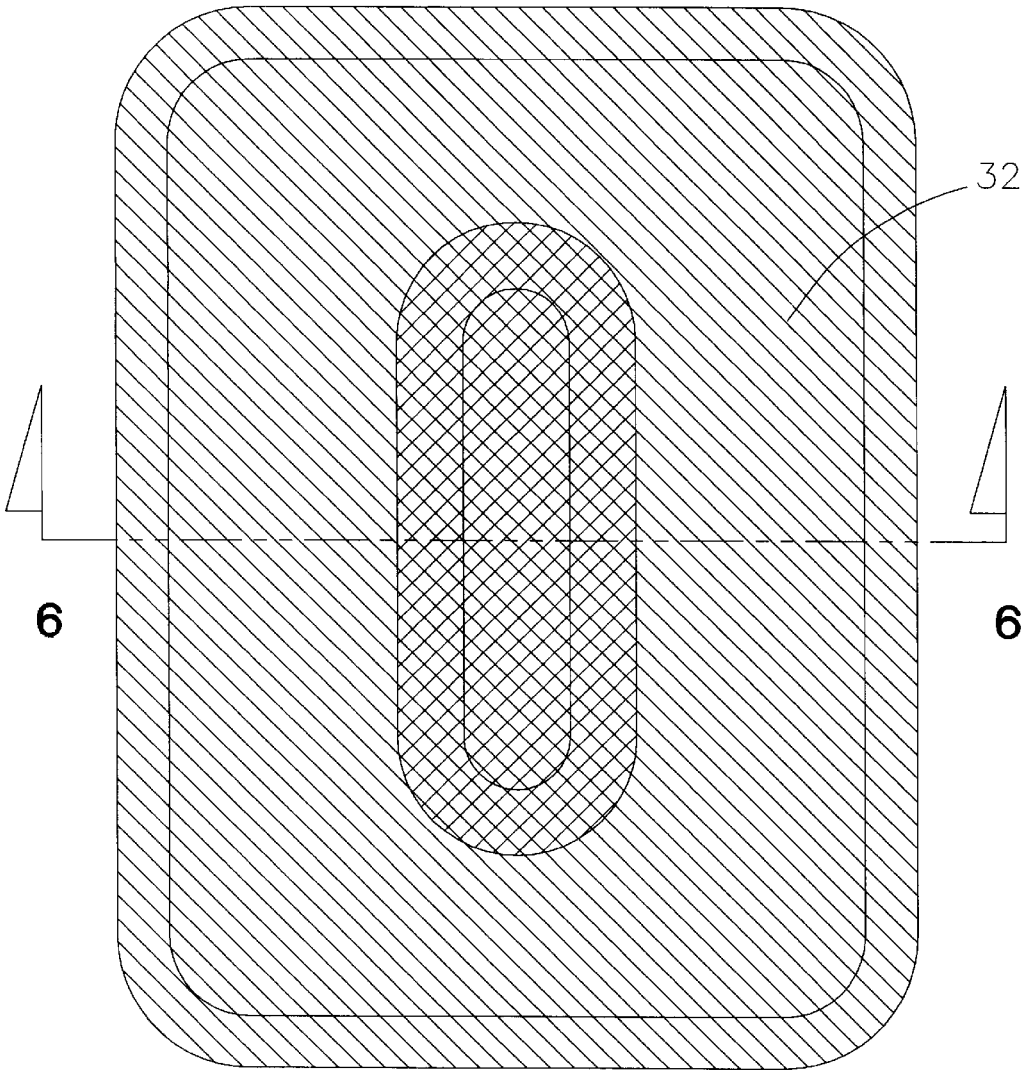
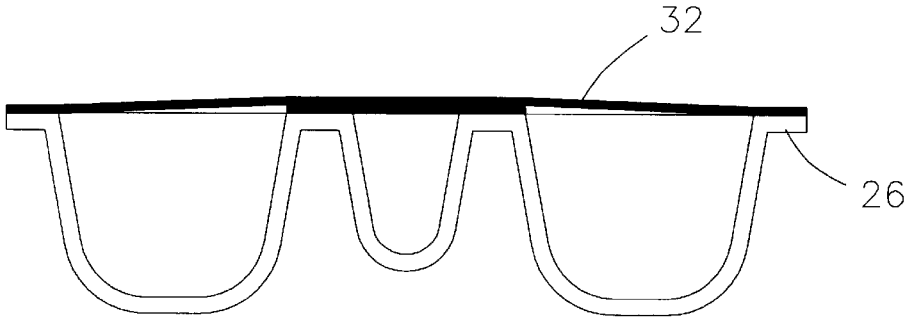
FIGURE 6

FIGURE 7
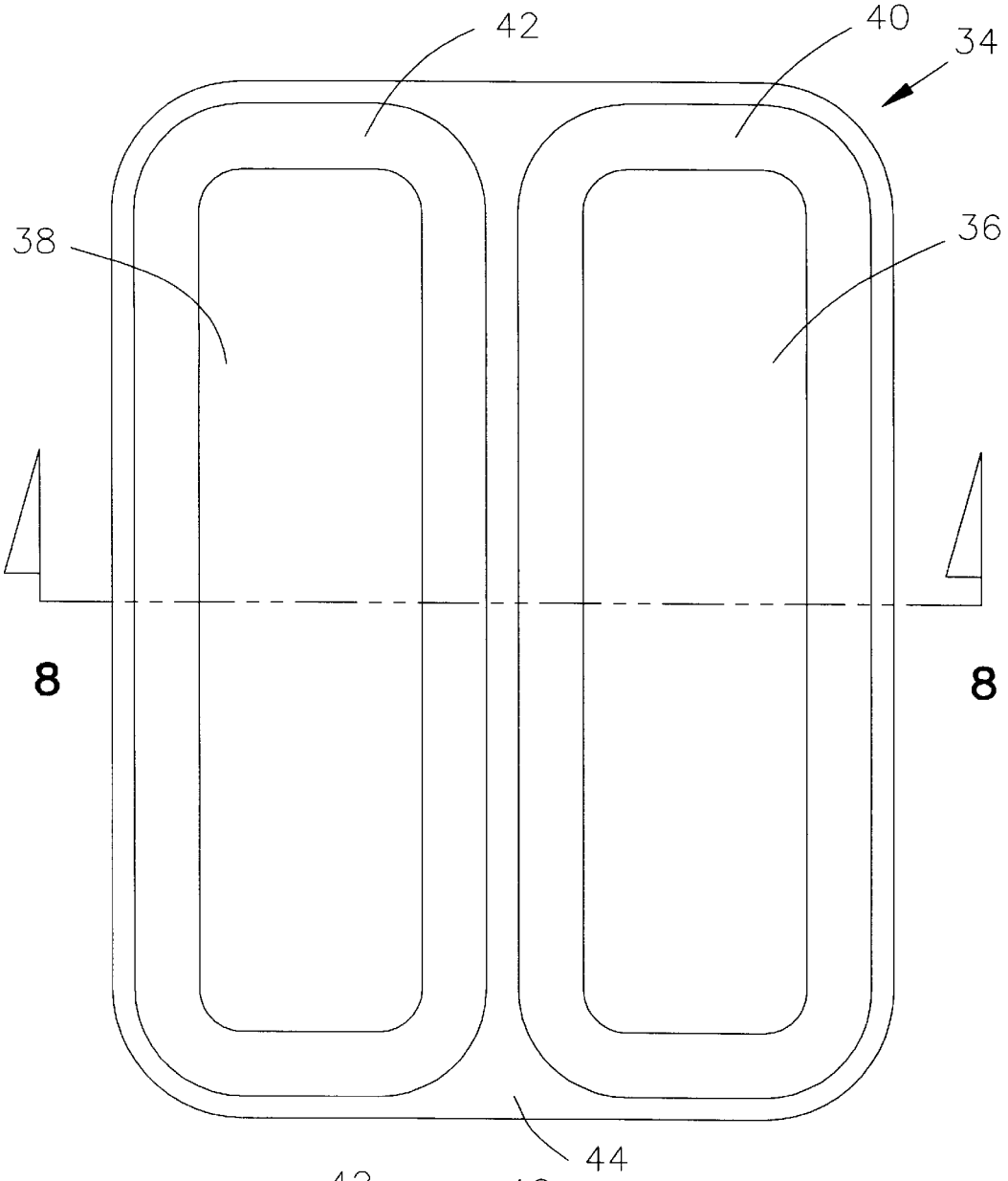
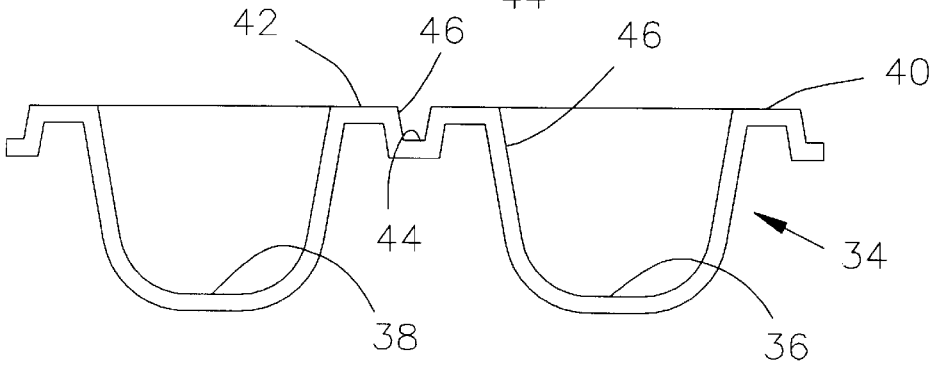
FIGURE 8

FIGURE 9
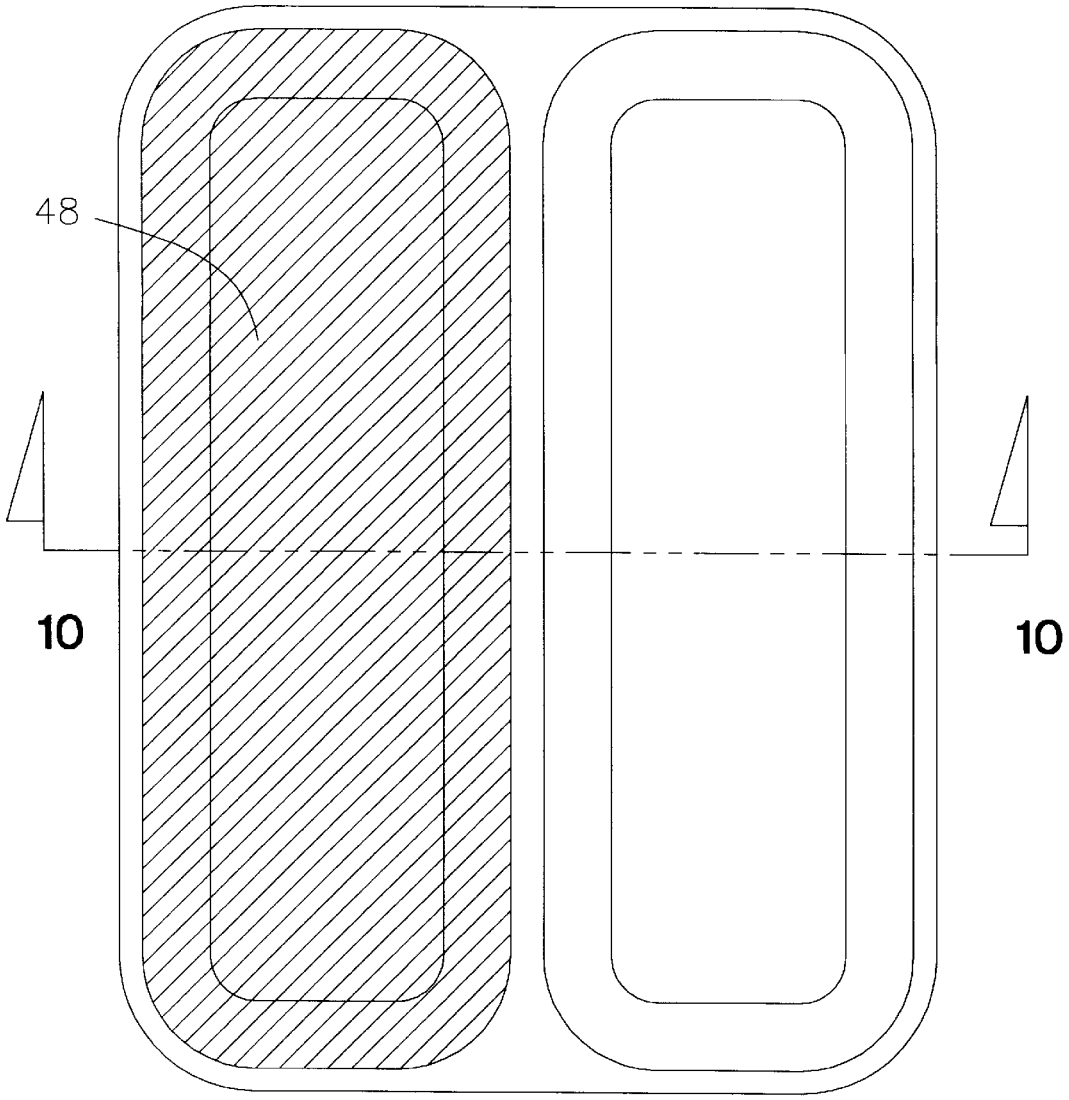
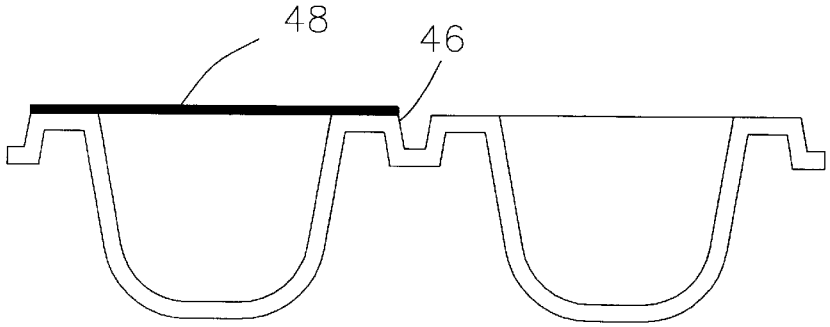
FIGURE 10

FIGURE 11
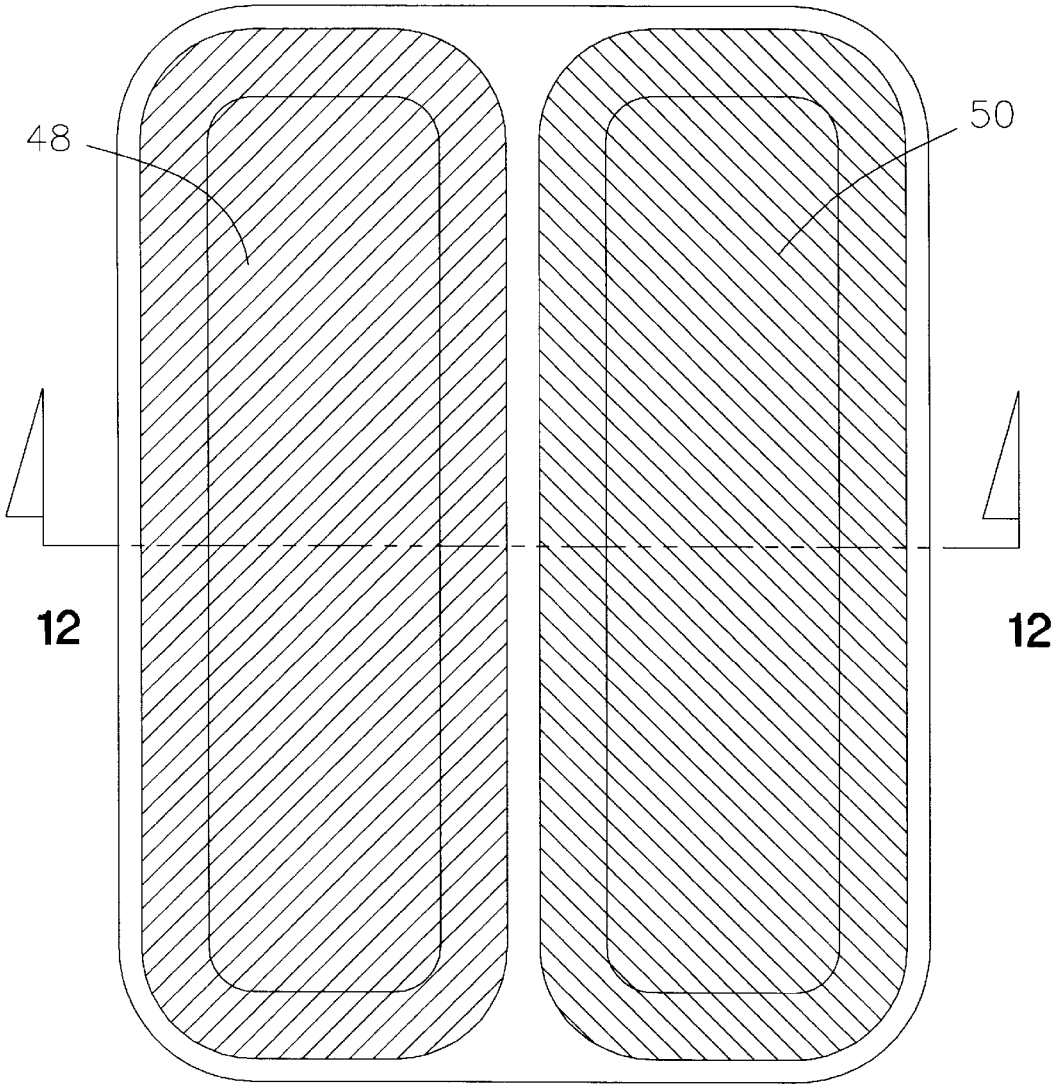
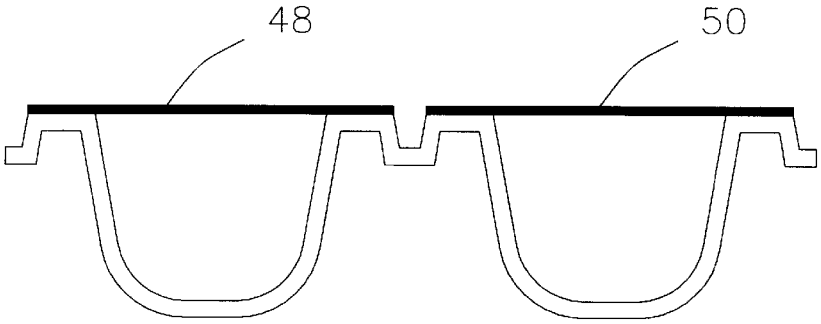
FIGURE 12

PLURAL ATMOSPHERE PACKAGE

CROSS-REFERENCE TO RELATED APPLICATIONS

This application is a continuation-in-part of patent application Ser. No. 08/559,657, filed Nov. 20, 1995 which is a continuation of patent application Ser. No. 08/459,102, filed Jun. 2, 1995 now abandoned, which is a continuation of patent application Ser. No. 08/216,918, filed Mar. 23, 1994 now U.S. Pat. No. 5,497,736, which is a continuation of patent application Ser. No. 08/064,700, filed May 20, 1993 now U.S. Pat. No. 5,348,752.

BACKGROUND OF THE INVENTION

This invention relates generally to food packaging and particularly to techniques for packaging food products in a modified gaseous atmosphere.

It has been proposed to package a variety of food products in modified atmosphere packaging. For example, meat products may have their shelf life extended if they are packaged in a reduced oxygen atmosphere until the time of sale is near. Thereafter, the packages can be exposed to a higher oxygen content environment causing the red meat product to "bloom", changing to the red color more familiar to retail consumers. Exemplary packages that facilitate the modified atmosphere packaging of meat are U.S. Pat. Nos. 5,439,132 and 5,419,096, hereby expressly incorporated by reference herein.

While oxygen exposure is detrimental to the shelf life of certain products, it is essential to the shelf life of other products, such as lettuce, bread and other items. In these cases, it is important to the texture and freshness of the product that it be exposed to a normal atmospheric environment.

Commercial food packages must be amenable to high speed packaging operations. Thus, any practical food package must not only have advantageous functional features, but it must also be designed to facilitate high speed manufacture, essential to achieving low cost. One exemplary high speed food packaging apparatus which is capable of modified atmosphere packaging is disclosed in U.S. Pat. No. 5,479,759, hereby expressly incorporated herein by reference.

SUMMARY OF THE INVENTION

In accordance with one aspect of the present invention, a food product package may include a tray with a pair of compartments. A first membrane covers at least one of the compartments while a second membrane covers the other of the compartments. The first and second membranes have different permeabilities.

DESCRIPTION OF THE DRAWING

FIG. 1 is a top plan view of one embodiment of a food product package;

FIG. 2 is a cross-sectional view taken generally along the line 2—2 in FIG. 1;

FIG. 3 is a top plan view of the food package of FIG. 1 after a membrane has been positioned over one of the compartments;

FIG. 4 is a cross-sectional view taken generally along the line 4—4 in FIG. 3;

FIG. 5 is a top plan view of the embodiment shown in FIG. 3 after a membrane has been positioned over the other of said compartments;

FIG. 6 is a cross-sectional view taken generally along the line 6—6 in FIG. 5;

FIG. 7 is a top plan view of another embodiment of a food package;

FIG. 8 is a cross-sectional view taken generally along the line 8—8 in FIG. 7;

FIG. 9 is a top plan view of the embodiment shown in FIG. 7 after a membrane has been positioned over one of the compartments;

FIG. 10 is a cross-sectional view taken generally along the line 10—10 in FIG. 9;

FIG. 11 is a top plan view of the embodiment in FIG. 9 after a second membrane has been positioned on the package; and FIG. 12 is a cross-sectional view taken generally along the line 12—12 in FIG. 11.

DESCRIPTION OF THE PREFERRED EMBODIMENTS

Referring to the drawing wherein like reference characters are used for like parts throughout the several views, a tray 20 for containing a food product (not shown) includes an outer compartment 22 and an inner compartment 24, as shown in FIGS. 1 and 2. The outer compartment 22 is surrounded by a flat outer flange 26 which is amenable to heat sealing of plastic films. The inner compartment 24 is defined peripherally by an inner flange 28 such that the inner flange 28 effectively defines an island in the outer compartment 22.

Referring to FIG. 2, the inner compartment 24 may have a depth slightly less than that of the outer compartment 22. Both the inner and outer compartments 22 and 24 may have a curved bottom profile. In addition, it may be advantageous in some circumstances that the inner flange 28 and the outer flange 26 be substantially coplanar.

The tray 20 may be made of a variety of materials including plastic films, foams and the like. Advantageously, the tray 20 is made of a material which is amenable to conventional heat sealing techniques.

Referring now to FIGS. 3 and 4, the inner compartment 24 may be closed by a first membrane 30 as illustrated in FIG. 3. The membrane 30 may be cut from a web of material and positioned in place on the tray. This operation is facilitated by the downward arrangement of the edges 31 which extend upwardly from the outer compartment to the inner flange 28. When a web of material (not shown) is positioned over the package 20, a cutting blade or a severing knife may be extended through the material into the outer compartment 22 to cut off the first membrane 30 in place on the tray 20.

Thereafter a second membrane 32 may be positioned over the first membrane 30 and cut to shape over the tray from a second web of material, as shown in FIGS. 5 and 6. Both the first membrane 30 and second membrane 32 are advantageously sealed to the respective outer flange 26 and inner flange 28 using heat sealing techniques. While the flanges 26 and 28 are illustrated as being of substantial length in the horizontal direction (in accordance with techniques utilized to form packages from plastic films), the flange size may be reduced in the horizontal direction in a variety of situations, including those wherein plastic foam is utilized to form the tray 20.

The two compartments 22 and 24 in the tray 20 may be utilized to contain materials which are exposed to different atmospheric conditions. In addition, the membranes 30 and 32 may have different permeabilities to gas.

For example, the membrane 30 may be substantially impermeable while the membrane 32 is substantially permeable or vice versa. One of the compartments 22 and 24 may contain a normal atmospheric gaseous environment, while the other, sealed by a substantially impermeable membrane, may contain a modified atmosphere environment. One useful modified atmosphere environment is one which is relatively low in oxygen content, compared to normal atmosphere. The reduced oxygen content extends the shelf life of a variety of products including red meat, chicken and other products.

While the tray 20 has been illustrated in a configuration with a pair of compartments, one concentric about the other, it should be appreciated that a plurality of compartments may be provided to accommodate specific circumstances.

Referring now to FIG. 7, another embodiment of a food package includes a tray 34 which defines a left compartment 36 and a right compartment 38. The tray 34 has bilateral symmetry. The left compartment 36 is defined by the left flange 40 while the right compartment 38 is defined by the right flange 42.

As shown in FIG. 8, a depressed land 44 extends peripherally about each compartment 36 and 38. The land 44 is connected to the flanges 40 and 42 by a downwardly directed portion 46, as shown in FIG. 8.

Referring to FIGS. 9 and 10, a left membrane 48 is shown in position on the tray 34. The right membrane 50 is shown in position in FIGS. 11 and 12. It may be advantageous to position the membranes on the tray sequentially. The membranes 48, 50 may be secured to the flanges by heat sealing.

The membranes 48 and 50 may be of different permeabilities. For example, one of the membranes may be substantially impermeable to atmospheric gases while the other is substantially permeable. Similarly, while two compartments are illustrated, a plurality of compartments may be provided to meet specific needs.

The configuration shown in FIGS. 9 through 12 facilitates the formation of the membranes 48 and 50 in place on the tray in a continuous manufacturing process. For example, the membranes may be cut, from a web using conventional severing techniques, in place on the tray since the positioning of the downwardly directed portions 46 and land 44 facilitates the cutting operation. That is, the severing machine can extend downwardly past the flanges 40 and 42 due to the positioning of the land 44 and portion 46. In this way, a continuous web of film may be passed over the tray to form one of the membranes 48 and thereafter the other of the membranes may be formed, using a second web of material. By cutting the membranes 48 and 50 out from the center of a continuously unwound web of film, there is no need to stop the manufacturing process. Instead film can be continuously unwound, the membranes may be formed in place on the tray, and the severed film collected in a winding operation on the other side.

Among the applications for the packages using the trays 20 and 34 are the provision of salad products in a packaged format. Lettuce may be contained in the outer compartment 22 while meat or salad dressing may be contained in the compartment 24, shown in FIGS. 1 to 6. In these cases, the membrane 30 may be a substantially impermeable membrane while the membrane 32 may be substantially permeable. This allows the lettuce to breath and stay fresh while the meat product or the salad dressing may be contained in an atmosphere low in oxygen content to extend its shelf life.

The package shown in FIGS. 7–12 may be utilized to contain sandwiches wherein one compartment contains the bread and the other compartment contains, for example, a meat product. The one compartment may be covered by a permeable membrane while the other compartment is covered by a substantially impermeable membrane. In this way, the bread may be allowed to breath so that it does not become soggy and the meat product may be sealed in an impermeable compartment filled with an inert atmosphere to extend the shelf life of the meat product.

Either of the trays 20 or 34 may be utilized to contain vegetables and dip. For example, the package shown in FIGS. 1 to 6, could include the dip in the center compartment while the surrounding compartment may be filled with vegetables. The dip may be require a high barrier packaging membrane while the vegetables require only a low barrier membrane.

Other examples of products which may be advantageously packaged together in different atmospheres includes berries and cream, chips and salsa, and yogurt and fruit.

While the present invention has been described with respect to a limited number of embodiments, those skilled in the art will appreciate numerous modifications and variations. It is intended that the appended claims cover all such modifications and variations as fall within the true spirit and scope of the present invention.

What is claimed is:

1. A package comprising:

a tray having a pair of compartments;

a first membrane covering at least one of said compartments;

a second membrane covering the other of said compartments;

said first and second membranes having different permeabilities; and a said pair of compartments in a side-by-side arrangement, a respective peripheral flange extending above each of said compartments, each of said flanges having a pair of edges, a respective downwardly directed portion of said tray extending downwardly from each of the adjacent edges of said flanges, said downwardly directed portions connecting to one another to form a depression between said flanges, to facilitate severing in place of a web on said flanges.

2. The package of claim 1 wherein said tray includes a pair of concentric compartments, one of said compartments comprising said depression.

3. The package of claim 1 including a pair of parallel compartments, said depression positioned between said compartments.

4. The package of claim 1 wherein one of said membranes covers both of said compartments.

* * * * *

UNITED STATES PATENT AND TRADEMARK OFFICE

CERTIFICATE OF CORRECTION

PATENT NO. : 5,901,848

DATED : May 11, 1999

INVENTOR(S) : Michael P. Gorlich and Robert F. McPherson, Jr.

It is certified that error appears in the above-identified patent and that said Letters Patent is hereby corrected as shown below:

Column 4, line 42, "a said" should be "said".

Signed and Sealed this

Twelfth Day of October, 1999

*Attest:*

Q. TODD DICKINSON

*Attesting Officer*

*Acting Commissioner of Patents and Trademarks*